US005375698A

United States Patent [19]

Ewart et al.

[11] Patent Number: 5,375,698

[45] Date of Patent: Dec. 27, 1994

[54] PREFILLED, RESEALABLE CONTACT LENS CONTAINER

[75] Inventors: William J. Ewart, Mayford Woking, England; Laurie C. Grau, Huntington Beach, Calif.

[73] Assignee: Allergan, Inc., Irvine, Calif.

[21] Appl. No.: 57,933

[22] Filed: May 7, 1993

[51] Int. Cl.[5] ..... A45C 11/04; B65D 43/12

[52] U.S. Cl. ..... 206/5.1; 206/205; 206/813; 220/345; 220/351; 220/359

[58] Field of Search ..... 206/5.1, 205, 210, 813; 422/300; 134/901; 220/345, 346, 351, 359

[56] References Cited

U.S. PATENT DOCUMENTS

| | | | |
|---|---|---|---|
| 3,049,224 | 8/1962 | Fredette et al. | 206/813 X |
| 3,650,386 | 3/1972 | Tigner | 206/813 X |
| 4,444,310 | 4/1984 | Odell | 206/813 X |
| 4,578,566 | 3/1986 | Bowen . | |
| 4,691,820 | 9/1987 | Martinez . | |
| 4,743,738 | 5/1988 | Ryder et al. . | |
| 5,053,208 | 10/1991 | Seamons et al. . | |
| 5,054,610 | 10/1991 | Ajello | 206/5.1 |
| 5,131,532 | 7/1992 | Ives . | |

FOREIGN PATENT DOCUMENTS

| | | | |
|---|---|---|---|
| 0074525 | 3/1989 | Japan | 206/5.1 |
| 449338 | 6/1936 | United Kingdom | 220/351 |

*Primary Examiner*—Bryon P. Gehman
*Attorney, Agent, or Firm*—Spensley Horn Jubas & Lubitz

[57] ABSTRACT

A container for holding contact lenses in contact lens treatment solutions which has a base member equipped with at least one compartment. Each compartment has a predetermined length and width situated in a juxtaposed position with a partition thereinbetween for holding the contact lens and a laterally projecting flange around the perimeter of the compartment. Each compartment is filled with a contact lens treatment solution. A layer of adhesive is deposited on the laterally projecting flange. A cover sheet member extending at least across the full length and width of the compartment is releaseably united to the base member at the flange by the layer of adhesive forming a fluid-tight seal. The layer of adhesive is capable of uniting the cover sheet member and the base member at the flange and forming a fluid-tight seal after repeated uniting and releasing between the two members. In an alternate embodiment, a sliding cover is used to slidingly engage the flange achieving a fluid-tight seal. The container may suitably be used to clean, disinfect, and rinse contact lenses for only once or for many times by the opening and the resealing of the container.

11 Claims, 1 Drawing Sheet

PREFILLED, RESEALABLE CONTACT LENS CONTAINER

FIELD OF THE INVENTION

This invention generally relates to a contact lens container prefilled with contact lens treatment solutions and more particularly relates to a ready-to-use recloseable and resealable contact lens container for holding contact lenses and contact lens treatment solutions that can be used to clean, disinfect, and rinse contact lenses either one time or several times before being discarded.

BACKGROUND OF THE INVENTION

In the care of contact lenses of various kinds, i.e., soft, hard, gas permeable, etc., a sterile environment is required where the lens can be disinfected and/or stored. This sterile environment usually means soaking the contact lens in a disinfecting or sterile solution. This is especially important in the care of soft contact lenses made of hydrophilic polymeric materials. These soft hydrophilic lenses require regular disinfecting. Additionally, when not in the eye they need to be stored in either a disinfecting solution or sterile saline solution in order to maintain their hydrated state. It is desirable for the contact lens wearer to have a readily accessible container for the safe disinfection and/or storage of the contact lenses.

Various designs of contact lens containers have been disclosed by others. For instance, U.S. Pat. No. 5,053,208 to Seamons, et al. discloses a contact lens disinfecting kit having an open-top lens container, an elongated piercer mounted in the lens container in an upright position such that the piercer divides the interior of the lens container into two separate contact lens receiving ports. The Seamons, et al. device requires elaborate effort of piercing the compartment before using the container and moreover, it does not have a resealable top.

U.S. Pat. No. 4,691,820 to Martinez discloses a molded blister package for storing and dispensing a hydrophilic contact lens having a base portion which includes a cavity surrounded by an outstanding flange and a sheet cover sealed to the flange to enclose the cavity. The Martinez package is mainly used for shipping and dispensing contact lenses and is not amenable to reclosure once the package is opened and sterility lost.

Numerous other patents were issued on permanent contact lens containers, for instance, U.S. Pat. No. 5,131,532 to Ives, U.S. Pat. No. 4,578,566 to Bowen, and U.S. Pat. No. 4,743,738 to Ryder, et al. These permanent contact lens containers are equipped with heating devices and therefore are not disposable.

It is therefore an object of the present invention to provide a contact lens container for holding contact lenses and contact lens treatment solutions that is readily accessible and can be carried around by the contact lens wearer.

It is another object of the present invention to provide a container for holding contact lenses and contact lens treatment solutions that is readily accessible and is reusable.

It is a further object of the present invention to provide a container for contact lenses that is prefilled with contact lens treatment solutions that can be easily used by the contact lens wearer to clean, disinfect, and store contact lenses.

It is yet another object of the present invention to provide a container prefilled with contact lens treatment solutions equipped with a recloseable and resealable top such that the container may be used once or may be used several times.

It is another further object of the present invention to provide a container prefilled with contact lens treatment solutions to be used by a contact lens wearer for the cleaning, disinfecting, and storing of contact lenses and then discarded after one use or several uses.

SUMMARY OF THE INVENTION

In accordance with the present invention, a contact lens container prefilled with contact lens treatment solutions that can be used either once or several times by utilizing a recloseable and resealable top is provided.

In the preferred embodiment, a contact lens container prefilled with contact lens treatment solutions and constructed with a base member having at least one compartment, and more preferably two compartments, is provided with a laterally projected flange around the perimeter of the base member, a reusable adhesive is deposited on the projecting flange, and a cover sheet member extending at least across the full length and width of the compartments is releaseably united to the base member at the flange by the adhesive and thus forming a fluid-tight seal. The layer of adhesive is chosen such that it is capable of uniting the cover sheet member and the base member at the flange repeatedly after several uniting and releasing operations between the two members.

In an alternate embodiment, a container is provided with a sliding cover equipped with means to slidingly engage the laterally projecting flange on the base member and extending across the full length and width of the base member so that a fluid-tight seal between the base member and the sliding cover can be obtained when the cover is in a fully closed position. A flexible cushion liner is used inside the cover member to provide a fluid-tight seal.

BRIEF DESCRIPTION OF THE DRAWINGS

Other objects, features and advantages of the present invention will become apparent upon consideration of the specification and the appended drawings, in which.

DETAILED DESCRIPTION OF THE EMBODIMENTS

Figure 1:
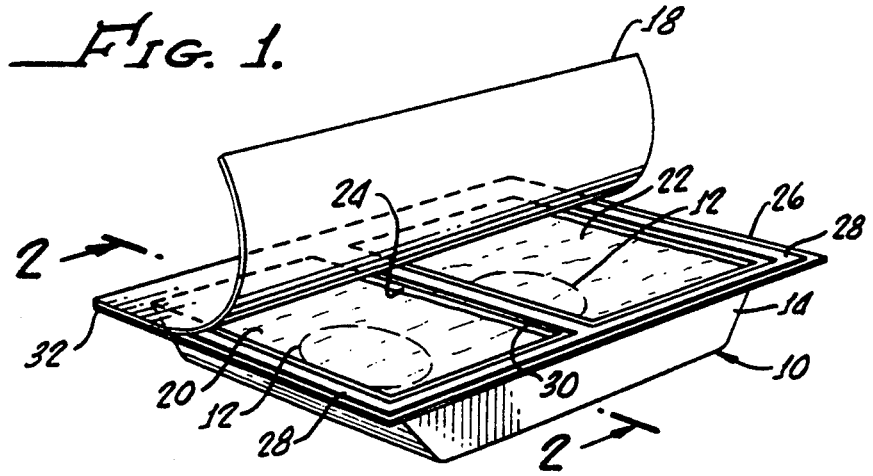
FIG. 1 is a schematic showing the preferred embodiment wherein a cover sheet member is partially peeled: back exposing the base member and the compartments.

Referring initially to FIG. 1, wherein a schematic view of container 10 having a base member 14 and a partially peeled back cover sheet member 18 is shown. The base member 14 has two compartments 20 and 22 and a partition 24 thereinbetween. A pair of contact lenses 12 are shown in the compartments. Lens care solution, either the same or different, are filled into compartments 20 and 22. It is also possible that the base member 14 contains only one compartment and therefore filled with only one solution. It should also be appreciated that other alternatives to solution such as powders, pills, etc., may be suitably used in compartments 20 and 22. The compartments 20 and 22 may be suitably marked left and right by molded-in symbols such that lenses for the left eye and for the right eye may be appropriately placed in each compartment without confusion.

The cover sheet member 18 extends at least across the full length and width of the two compartments 20 and ;22 and covers the flange ;26. The laterally projecting flange 26 should have a suitable width such that adequate adhesion between the cover sheet member 18 and flange 26 may be obtained by the adhesive layer 28 deposited on flange ;26. It should be noted that the adhesive layer 28 covers most of the flange area 26 around the perimeter of the compartments 20 and 22 including the center flange area 30.

Figure 2:
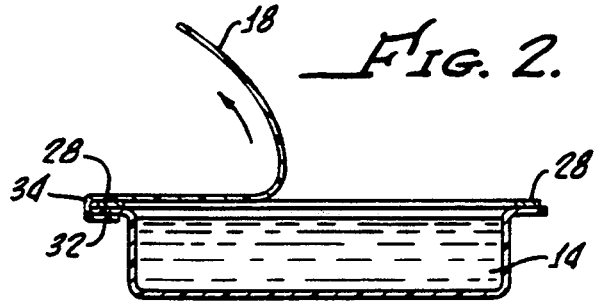
FIG. 2 is a cross-sectional view taken along 2—2 in FIG. I showing the wrap-around arrangement of the cover sheet member at the rear flange of the base member.

A cross-sectional view taken along section 2—2 in FIG. 1 is shown in FIG. 2. It should be noted that the cover sheet member 18 is wrapped around the rear flange 32 forming a rear edge wrap 34. This rear edge wrap 34 at the rear flange 32 prevents the user from accidentally peeling the cover sheet member 18 completely off the base member 14.

Figure 3:
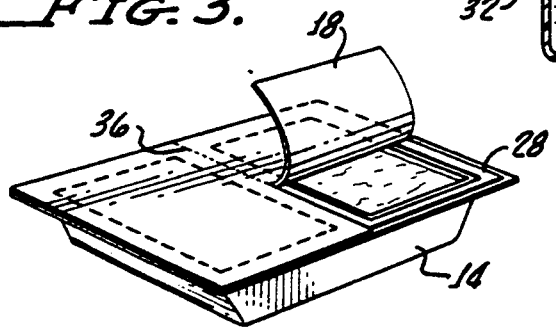
FIG. 3 is a schematic showing a variation of the preferred embodiment in which only half of the cover sheet member for one compartment is peeled back.

FIG. 3 shows a slight variation from the preferred embodiment in FIG. 1. It is seen that the cover sheet member 18 has a perforated line 36 along the center of the sheet member overlapping the center flange 30 of the base member 14. The perforated line 36 facilitates the tearing of the cover sheet member 18 along the center such that one side of the cover sheet member 18 may be peeled back from the base member 14 independently of the other side. This enables the user to use a single compartment at a time without opening and possibly contaminating the other compartment.

The base member 14 which may alternately contain one, two, three or more compartments, can be suitably injection molded of plastic materials or thermoformed from extruded plastic sheets. A suitable plastic material may be polypropylene, polyethylene, high density polyethylene, ultra high molecular weight polyethylene, polyamide, ABS, polystyrene, maleic arthydride modified polystyrene and polycarbonate. The material should be capable of being sterilized at 120° C. without substantial loss of its physical properties of dimensional stability, warpage, and shrinkage. The plastic material should also have low water and vapor permeability to prevent the evaporation of the lens treatment solution. The plastic material should not be permeable to bacteria in order to avoid contamination.

The cover sheet member 18 may be a film made of a plastic material that has small elongation upon stretching, or a metal foil that has a plastic coating on the side facing the solution, or a laminated metal foil/plastic film. The elastic material or the metal foil should have chemical resistance to those chemicals that are normally found in lens care solutions.

The adhesive layer 28 used on flange 26 should be selected such that it is capable of providing a fluid-tight seal between cover sheet member 18 and base member 14, and furthermore, of providing a fluid-tight seal after repeated uniting and releasing between the two members. This is to ensure that the cover sheet member 18 after being peeled off can be reclosed and resealed on top of the base member 14 such that lens container 10 may be used several times before it is discarded. We believe that a suitable adhesive for this purpose may be a pressure-sensitive type adhesive such as those of polybutadiene, polyisoprene, natural rubber, nitrile rubber, epoxy-nylon, nitrilephenolic, neoprene-phenolic, and vinyl-phenolic. Other closure means not using adhesives such as a zip-lock type of arrangement may also be used so long as a fluid-tight seal can be obtained. A suitable thickness for the adhesive layer may be any thickness between about 0.0001 inches to about 0.125 inches.

According to the present invention, a method of using a container for holding contact lenses and contact lens treatment solutions, can be carried out by first providing a base member 14 having at least two compartments 20 and 22 each having a predetermined length and width situated next to each other with a partition 24 thereinbetween and a laterally projecting flange 26 and 30 around the perimeter of the compartments. A layer of suitable adhesive having a sufficient thickness is then deposited on flange 26 and 30. The compartments are then filled with at least one contact lens treatment solution such that one solution is filled into each compartment. The cover sheet member 18 is then united to the base member 14 by the adhesive layer 28 forming a fluid-tight seal. The layer of adhesive 28 is capable of uniting the cover sheet member 18 and the base member 14 and forming a fluid-tight seal even after repeated uniting and releasing between the two members.

Figure 4:
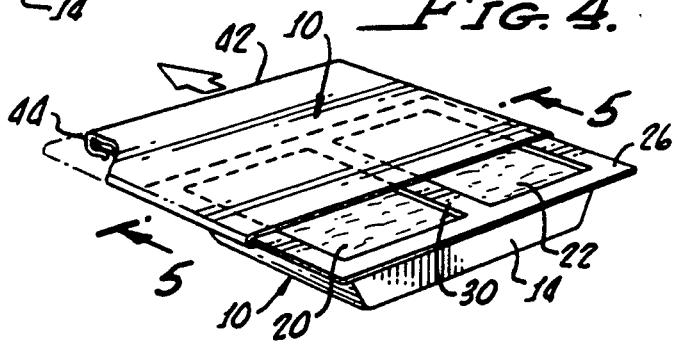
FIG. 4 is a schematic showing the alternate embodiment in which a sliding cover is partially sealing the top of a base member.
Figure 5:
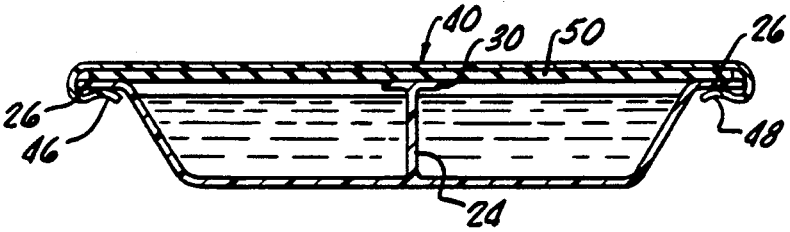
FIG. 5 is a cross-sectional view taken along 5—5 in FIG. 4 showing the sliding cover member equipped with the slidingly engaging means and the flexible liner sealing means.

FIG. 4 shows one of the alternate embodiments of the present invention in which a sliding cover member 40 is utilized to provide a fluid-tight seal on base member 14. A cross-sectional view taken along section 5—5 in FIG. 4 is shown in FIG. 5. It should be noted that sliding cover member 40 is equipped with a stop 44 at the rear edge 42. This is shown in the break-away view in FIG. 4. The stop 44 provides a convenient guide in closing the sliding cover member 40 on the base member 14 along flange 26 such that it can not accidentally slide off base member 14.

The sliding cover member 40 is equipped with sliding engagement means 46 and 48 at each end of the cover member which provides a spring closure action on flange 26 of the base member 14 so that cover member 40 is pressed tightly against flange 26 providing a fluid-tight seal. A flexible cushion liner 50 is used inside the sliding cover member 40 to facilitate the fluid-tight seal. This flexible cushion liner can suitably be made of an elastomeric material such as neoprene rubber, nitrile rubber, urethane rubber, etc., a foam material such as polyurethane foam, polyester foam, neoprene foam, etc., or any other flexible and pliable sheeting material. It should have adequate chemical resistance to chemicals that are normally found in lens treatment solutions for cleaning, disinfecting, rinsing, and wetting contact lenses.

The sliding cover member 40 may be suitably molded of a plastic material such as those used for base member 14.

FIG. 4 shows that sliding cover member 40 is slid off half way on base member 10 such that half of the opening for compartments 20 and 22 are exposed. It is possible to mark the two compartments each as left and right to facilitate the use for the left eye lens and the right eye lens.

It should be noted that the sliding cover member 40 described in the alternate embodiment is only one of the preferred means for achieving a fluid-tight seal on the base member 14. Other types of closure means including, but not limited to, a press-on lid should also function satisfactorily.

To further facilitate the use of the present invention, a plurality of lens containers may be packaged together in strips in which the containers are connected to each other along the sides that can be easily separated. A user may suitably choose a strip package for weekly, biweekly or monthly usage and carry them conveniently in a ready-to-use condition.

While this invention has been described in an illustrative manner, it should be understood that the terminology used is intended to be in the nature of words of description rather than of limitation.

Furthermore, while the invention has been described in terms of a preferred and an alternate embodiment thereof, it is to be appreciated that those skilled in the art will readily apply these teachings to other possible variations of the invention.

The embodiments of the invention in which an exclusive property or privilege is claimed are defined as follows:

What is claimed:

1. A container for holding contact lenses and contact lens treatment solutions comprising:

a base member comprising a compartment having a predetermined length and width for holding a contact lens and a laterally projecting flange around the perimeter of said compartment;

said compartment being defined by a bottom surface and side wall surfaces extending between said bottom surface and said laterally projecting flange;

said compartment being filled with a contact lens treatment solution; and a cover member equipped with means unitary therewith to slidingly engage said laterally projecting flange on said base member and extending across the full length and width of said compartment to provide a fluid-tight seal for said container so that contact lenses may be deposited into or retrieved from said compartment in said container by the opening and closing of said cover member.

2. The container according to claim 1 wherein the base member is made of a plastic material selected from the group consisting of polypropylene, polyethylene, high density polyethylene, ultra high molecular weight polyethylene, polyamide, ABS, polystyrene, maleic anhydride modified polystyrene, and polycarbonate.

3. The container according to claim 1 wherein the base member is made of a material capable of being sterilized at 120° C. without loss of more than 20% of its physical properties.

4. The container according to claim 1 wherein the base member is made of a material having negligible water permeability.

5. The container according to claim 1 wherein the base member is made of a material not permeable to bacteria.

6. The container according to claim 1 wherein the cover member is made of a plastic material selected from the group consisting of polypropylene, polyethylene, high density polyethylene, ultra high molecular weight polyethylene, polyamide, ABS, polystyrene, maleic anhydride modified polystyrene, and polycarbonate.

7. The container according to claim 1 wherein the contact lens treatment solution is selected from the group consisting of a contact lens cleaning solution, contact lens disinfecting solution, contact lens rinsing solution, and a contact lens wetting solution.

8. The container according to claim 1, wherein said base member has a plurality of compartments each having a predetermined length and width situated in a juxtaposed position with a partition separating each compartment from adjacent compartments, each said compartment being filled with a contact lens treating solution, said laterally projecting flange extends around the perimeter of said juxtaposed compartments, and said cover member extends at least across the full length and width of said juxtaposed compartments.

9. A method of making a container for holding contact lenses and contact lens treatment solutions comprising the steps of:

providing a base member comprising a compartment having a predetermined length and width and a laterally projecting flange around the perimeter of said compartment;

said compartment being defined by a bottom surface and side wall surfaces extending between said bottom surface and said laterally projecting flange;

filling said compartment with a contact lens treatment solution;

providing a cover member equipped with means unitary therewith to slidingly engage the laterally projecting flange on said base member, said cover member is sufficient in size to extend across the full length and width of said compartment;

slidingly engaging said cover member with said laterally projecting flange on said base member so that a fluid-tight seal is obtained when said cover member is placed in a fully closed position on said base member.

10. The method according to claim 9, wherein said base member has a plurality of compartments each having a predetermined length and width situated in a juxtaposed position with a partition separating each compartment from adjacent compartments, and each said compartment is filled with a contact lens treating solution.

11. A container for holding contact lenses and contact lens treatment solutions comprising:

a base member comprising a compartment having a predetermined length and width for holding a contact lens and a laterally projecting flange around the perimeter of said compartment;

said compartment being defined by a bottom surface and side wall surfaces extending between said bottom surface and said laterally projecting flange;

said compartment being filled with a contact lens treatment solution;

a cover member equipped with means unitary therewith to slidingly engage said laterally projecting flange on said base member and extending across the full length and width of said compartment to provide a fluid-tight seal for said container so that contact lenses may be deposited into or retrieved from said compartment in said container by the opening and closing of said cover member; and a flexible cushion liner sealingly disposed inside said cover member.

* * * * *